US007973814B2

(12) United States Patent
Fukutani et al.

(10) Patent No.: US 7,973,814 B2
(45) Date of Patent: Jul. 5, 2011

(54) THERMAL TRANSFER PRINTER

(75) Inventors: Atsushi Fukutani, Mie (JP); Tomoaki Ueda, Mie (JP)

(73) Assignee: Sinfonia Technology Co., Ltd., Tokyo (JP)

( * ) Notice: Subject to any disclaimer, the term of this patent is extended or adjusted under 35 U.S.C. 154(b) by 118 days.

(21) Appl. No.: 12/481,917

(22) Filed: Jun. 10, 2009

(65) Prior Publication Data

US 2009/0309949 A1 Dec. 17, 2009

(30) Foreign Application Priority Data

Jun. 11, 2008 (JP) ..... 2008-152735

(51) Int. Cl.
*B41J 2/325* (2006.01)

(52) U.S. Cl. ..... 347/216

(58) Field of Classification Search ..... 347/216, 347/217

See application file for complete search history.

(56) References Cited

U.S. PATENT DOCUMENTS 5,164,744 A * 11/1992 Yoshida et al. ..... 347/217

FOREIGN PATENT DOCUMENTS

JP 2002-144614 A 5/2002

OTHER PUBLICATIONS

Machine-generated translation of JP 2002-144614, published on May 22, 2002.*

* cited by examiner

*Primary Examiner* — Huan H Tran
(74) *Attorney, Agent, or Firm* — Westerman, Hattori, Daniels & Adrian, LLP

(57) ABSTRACT

A thermal transfer printer includes: a peeling roller which is disposed downstream of a printing position set between a thermal head and a platen roller and defines a peeling start position of an ink ribbon; and a tension plate which is disposed on a further downstream side than the peeling roller and slidably stretches the ink ribbon under a tension relative to the printing position, via the peeling roller. With a back tension being ensured by means of the tension plate to prevent slackness of the ink ribbon, the peeling roller performs peeling, thereby avoiding retention of dust or the like and the lowered quality of paper due to such retention. In this manner, problems such as wrinkles occurring with the ink ribbon are eliminated without damaging paper, and further, improvement of printing quality is compatible with that of paper quality, through a design based upon a mechanism concerning the occurrence of wrinkles.

8 Claims, 5 Drawing Sheets

THERMAL TRANSFER PRINTER

BACKGROUND OF THE INVENTION

1. Field of the Invention

The present invention relates to a thermal transfer printer to cope with a problem with the occurrence of flaws on paper due to the dust or the like retained at a peeling position or a problem with non-uniform printing due to wrinkles occurring with an ink ribbon.

2. Description of the Related Art

In a thermal transfer printer employing an ink ribbon, the ink ribbon and paper are sandwiched between a thermal head and a platen roller, a heat is imparted to the ink ribbon by means of the thermal head, and dyestuff of the ink ribbon is transferred to paper. The ink ribbon needs to be peeled and taken up after printing. Therefore, a peeling member is disposed downstream of a printing position, so that the ink ribbon is guided in a direction departing from the paper, as disclosed in JP-A 2002-144614 (hereinafter, referred to as Patent Document 1).

In the Patent Document 1, a peeling plate is employed as a peeling member. This peeling plate is formed in a curved shape such that a site positioned at the downstream side of a paper-feeding direction, of a contact portion coming into contact with the ink ribbon, becomes the most protuberant at a center part in the widthwise direction of the ink ribbon. In this manner, the center part in the widthwise direction of the ink ribbon, of a peeling portion between the ink ribbon and the paper, is first peeled off from the paper, and the sites positioned at both ends in the widthwise direction of the ink ribbon are then peeled off from the paper. A first peeling force acting upon the peeling portion between the ink ribbon and the paper is thereby reduced, so that the ink ribbon can be peeled off from the paper without damaging the paper.

DISCLOSURE OF THE INVENTION

Problem(s) to Be Solved by the Invention

However, if the ink ribbon and the paper are peeled off from each other with the use of the abovementioned peeling plate, the paper and the ink ribbon are pressed against each other on the peeling plate. Therefore, the dust or the like adhering to a back face of the ink ribbon is prone to be retained at a slide portion of the peeling plate. Due to the adherence and retention of the dust, a force of pressing against the paper locally increases, further causing the lowered quality of paper such as paper-face flaws.

The abovementioned peeling plate is provided as one of the countermeasures that is based upon a finding that a peeling force simultaneously acts on the ink ribbon along a widthwise direction simultaneously, whereby wrinkles occur with a paper face. A printer of this type needs to take countermeasure against wrinkles occurring with the ink ribbon top side through a mechanism that follows.

In other words, as shown in FIG. 5, where a respective one of a ribbon width W2 of an ink ribbon 4 and a roll width W3 of a ribbon roll 7 is larger in comparison with a printing width W1 of a printing position P, caused by a thermal head 2 and a platen roller 5, a conveyance force f2 at an end side becomes relatively stronger in comparison with a conveyance force f1 at a widthwise center part of the ink ribbon 4, due to a resistance at the printing position P. The end side of the ink ribbon 4 acts as an ahead side and the center side acts as a delay side, causing the occurrence of wrinkles at the side of the ink ribbon 4 as indicated by the shaded X in the figure.

Of the ink ribbon 4, a larger thermal load is applied to a printed site in comparison with a site other than the printed site. Where high-density printing is applied, for example, more damage occurs mainly with a center part of the ink ribbon 4, and therefore, and thus, the center part thereof is more easily expandable in comparison with the end. It is also believed that this situation accelerates the occurrence of wrinkles indicated by the shaded X in the figure.

The Patent Document 1 also describes that a peeling roller can be employed as a peeling member in place of the peeling plate. When such a peeling roller is employed, the roller always rotates, thus reducing the amount of dust retention at one site, eliminating a local pressing force acting on paper, and raising a possibility that the quality of paper can be assured. However, the peeling roller rolls together with the paper, thus lowering a tension of the ink ribbon. Due to this lowered tension, it is anticipated that the ink ribbon becomes wrinkled, and in turn, the occurrence of non-uniform printing is accelerated.

The present invention has been made based upon such new finding. It is an object of the present invention to provide a heat transfer printer to achieve a construction of improving the quality of paper without accelerating the occurrence of wrinkles at the ink ribbon top side. In this construction, further, the occurrence of wrinkles is appropriately eliminated or reduced by taking countermeasure based upon a mechanism concerning the occurrence of wrinkles at the abovementioned ink ribbon top side. In this manner, improvement of the quality of paper is appropriately compatible with that of printing quality.

SUMMARY OF THE INVENTION

In order to achieve the above-described object, the present invention provides the following means.

A thermal transfer printer is characterized by including: a peeling roller which is disposed downstream of a printing position set between a thermal head and a platen roller, and defines a peeling start position of an ink ribbon; and a tension member which is disposed on a further downstream side than the peeling roller, and slidably stretches the ink ribbon under a tension relative to the printing position, via the peeling roller.

According the present invention, a peeling roller is set at a peeling start position and a tension member is disposed on a downstream side than the peeling start position and an ink ribbon is brought into slide contact with this tension member, so that a back tension is applied to the ink ribbon situated at a printing position via the peeling roller from the tension member.

With slackness of an ink ribbon and acceleration of the occurrence of wrinkles being effectively avoided by means of a tension member, a peeling roller is set at a peeling base point with the roller rolling with the ink ribbon. Thus, it becomes possible to effectively eliminate a problem such as lowered quality of paper due to retention of dust or the like at one site, and then, damaging the paper. Moreover, the tension member is positioned at the downstream side distant from a peeling position. At this position, a used ink ribbon alone is brought into pressure contact with a tension plate, and paper is already peeled and does not exist. Therefore, even if dust or the like is retained at the tension member, inconvenience such as damaging the paper never occurs.

In the above-described construction, in order to actively cope with the occurrence of ink ribbon wrinkles, it is desirable that the ribbon opposite face of the tension member is formed to be more protuberant at the center side than at the widthwise end side (in a curved shape, for example).

By doing this, a back tension at a respective one of the sites along the widthwise direction of the ink ribbon can be controlled, thus effectively eliminating an unbalanced state such as a state in which an ink ribbon expands in the widthwise center part or a state in which the conveyance force of the ink ribbon at the widthwise end becomes relatively strong. Therefore, a significant effect is attained in preventing the occurrence of wrinkles with the ink ribbon.

While a tension member can be constructed partly of a block body, it is desirable to employ an extension plate made of a plate member as the tension member in order to easily achieve a simplified structure and an appropriate degree of curvature according to print characteristics.

The construction of the present invention can be extremely effective by applying it to a thermal transfer printer having a relationship in which a respective one of a ribbon width of an ink ribbon and a roll width of a ribbon roll is larger in comparison with a printing width at a printing position set between a thermal head and a platen roller.

Advantageous Effect(s) of the Invention

With the above-described construction, the present invention can provide a novel, effective thermal transfer printer which can eliminate the lowered quality of paper due to dust retention while minimizing the occurrence of wrinkles with an ink ribbon; which enables a design for appropriate countermeasures against wrinkles, which are based upon a mechanism concerning the occurrence of wrinkles; and which allows improvement of the quality of paper to be appropriately compatible with that of printing quality.

DESCRIPTION OF THE PREFERRED EMBODIMENTS

Figure 1:
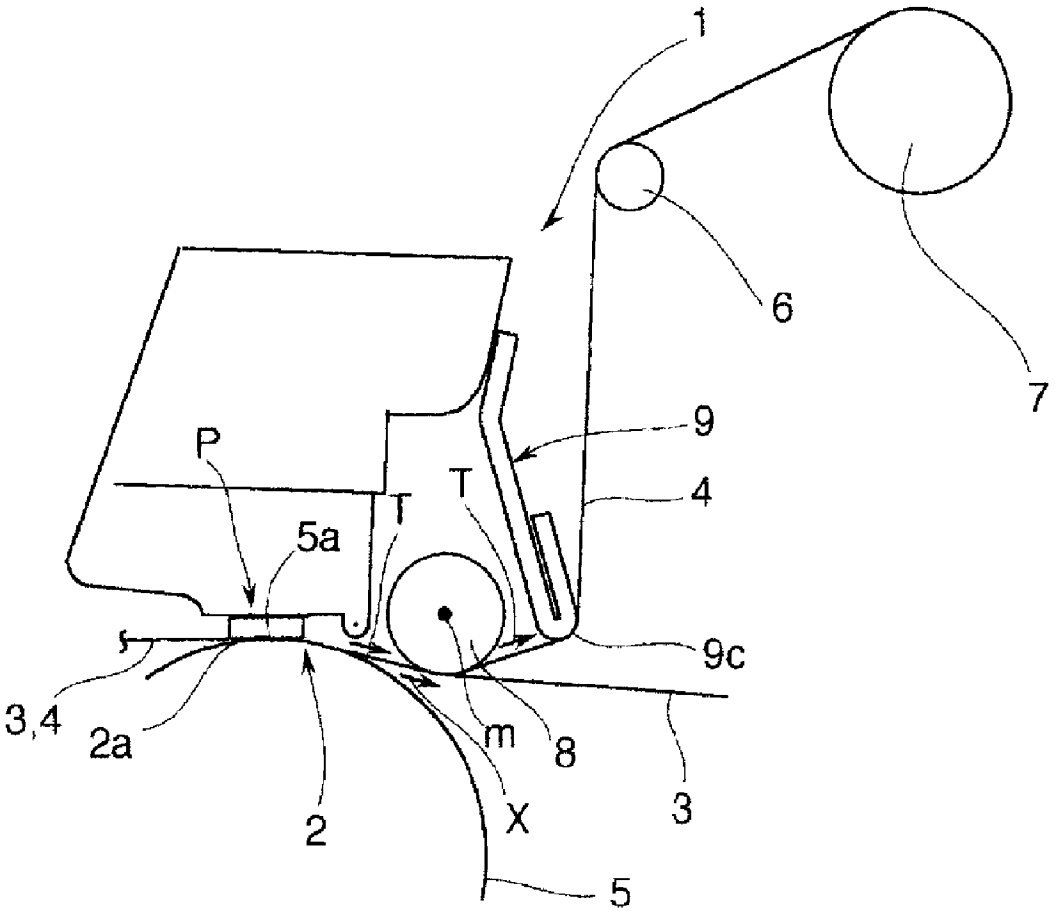
FIG. 1 is a view schematically showing essential parts of a thermal transfer printer according to one embodiment of the present invention.

Hereinafter, one embodiment of the present invention will be described referring to the drawings.

A thermal transfer printer according to the embodiment is of a line dye-sublimation type, and a thermal head structure 1 is provided with a thermal head 2, as schematically shown in FIG. 1. The thermal head 2 extends in a paper-face vertical direction orthogonal to the conveyance direction of paper 3 and an ink ribbon 4 (the direction indicated by X assigned to a superimposed position), and a plurality of heating elements (not shown) are disposed on a printing face 2*a* in an arrayed manner so as to be selectively heated based upon an external print signal. A platen roller 5 is rotatably arranged at an opposite position of this thermal head 2, and an outer circumferential face 5*a* is opposed to the printing face 2*a* of the thermal head.

The thermal head 2 is drivable to be elevated by means of a head drive mechanism (not shown). In the head-down state shown, the printing face 2*a* is brought into elastic contact with the platen roller 5, and a printing position P is set between the printing face 2*a* and the outer circumferential face 5*a* of the platen roller 5.

Between the platen roller 5 and the thermal head 2, paper 3 and the ink ribbon 4 are inserted into the platen roller 5 and the thermal head 2, respectively, in accordance with a relationship in which the paper and ink ribbon are positioned between the platen roller 5 and the thermal head 2. In the head-down state, printing is executed in a pressure-contact state therebetween, and the dyestuff of the ink ribbon 4 is transferred to the paper 3.

Downstream of the printing position P, a ribbon roll 7 is disposed via a guide roller 6. The ribbon roll 7 is connected to a motor (not shown), rotates in synchronism with a print signal for the thermal head 2, and takes up the ink ribbon 4. Likewise, the paper 3 is also driven in the conveyance direction by means of a roller such as a feed roller or a pinch roller, in synchronism with the print signal for the thermal head 2.

While the ink ribbon 4 and the paper 3 are superimposed on each other on the periphery of the printing position P, there is a need to peel the ink ribbon 4 and the paper 3 from each other after printing; take up the ink ribbon 4 by the ribbon roll 7; and feed the paper 3 to a page-cutting position by means of a feed roller (not shown).

Therefore, in the embodiment, among them, in part of a line from peeling to take-up of the ink ribbon 4, a peeling roller 8 is disposed downstream of the printing position P; and a tension plate 9, which is a tension member for stretching the ink ribbon 4 between the plate and the printing position P under a tension, is disposed in the further downstream than this peeling roller 8.

The peeling roller 8 acts as a base point of peeling the ink ribbon 4 and the paper 3 from each other, and is a follower roller that is rotatably mounted on part of the thermal head structure 1 via an axis "m" in a line direction.

The tension plate 9 is mounted on part of the thermal head structure 1 with a ribbon opposite face 9*c* being pressed against the ink ribbon 4 existing at a site ranging from the peeling roller 8 to the guide roller 6. This tension plate 9 forms the ribbon opposite face 9*c* formed in the cross-sectional R shape at a position at which an edge portion of a plate member is folded, and a tension is applied to the ink ribbon 4 while an angle is varied along this R-shaped portion. While the longitudinal direction of the tension plate 9 (paper-face vertical direction) is basically taken along a line, the tension plate 9 is not linear in detail. This plate is formed to be gently curved in a direction orthogonal to the longitudinal direction and to be the most protuberant at its center.

Figure 2:
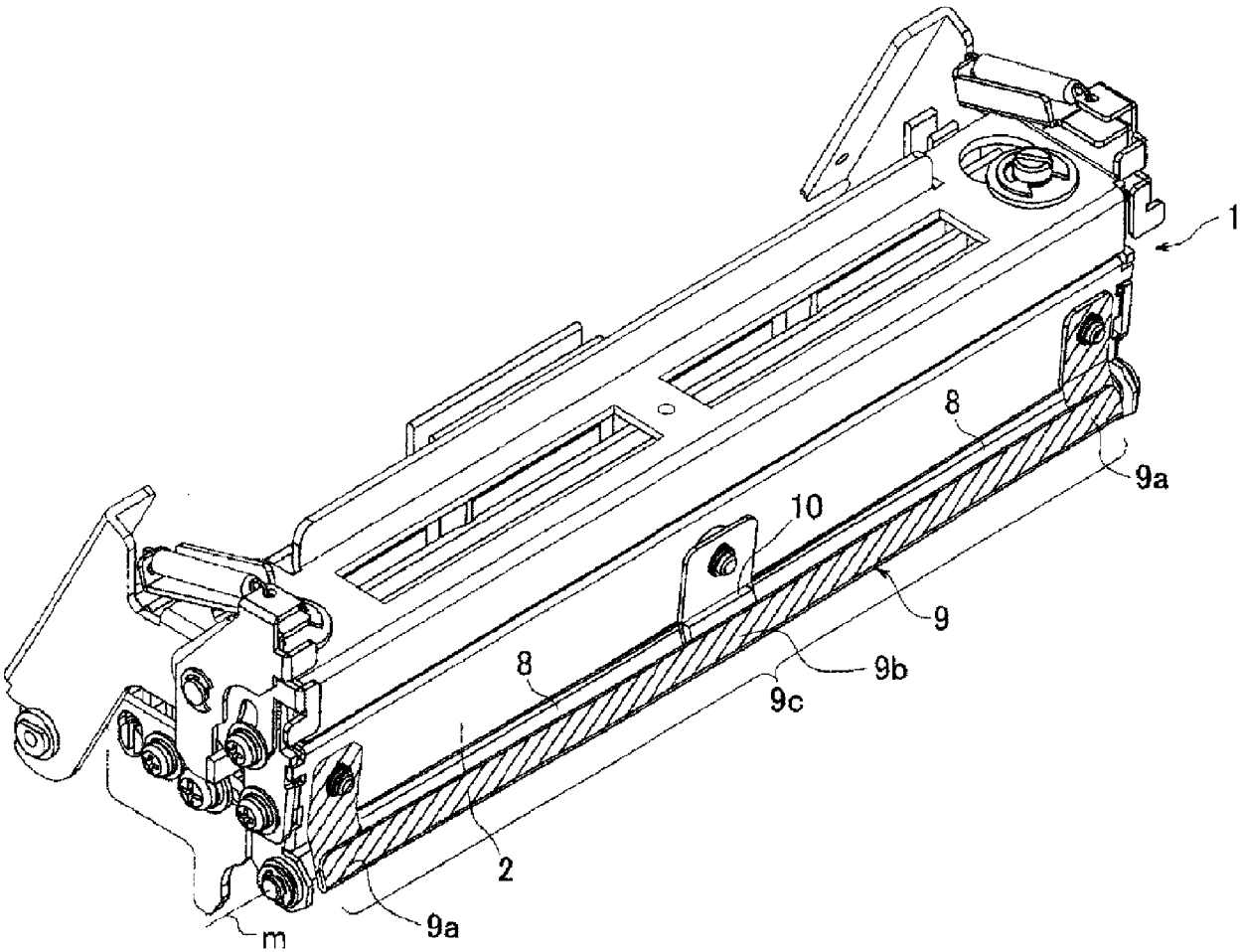
FIG. 2 is a perspective view showing a specific construction of the periphery of a thermal head constituting the thermal transfer printer of FIG. 1.
Figure 3:
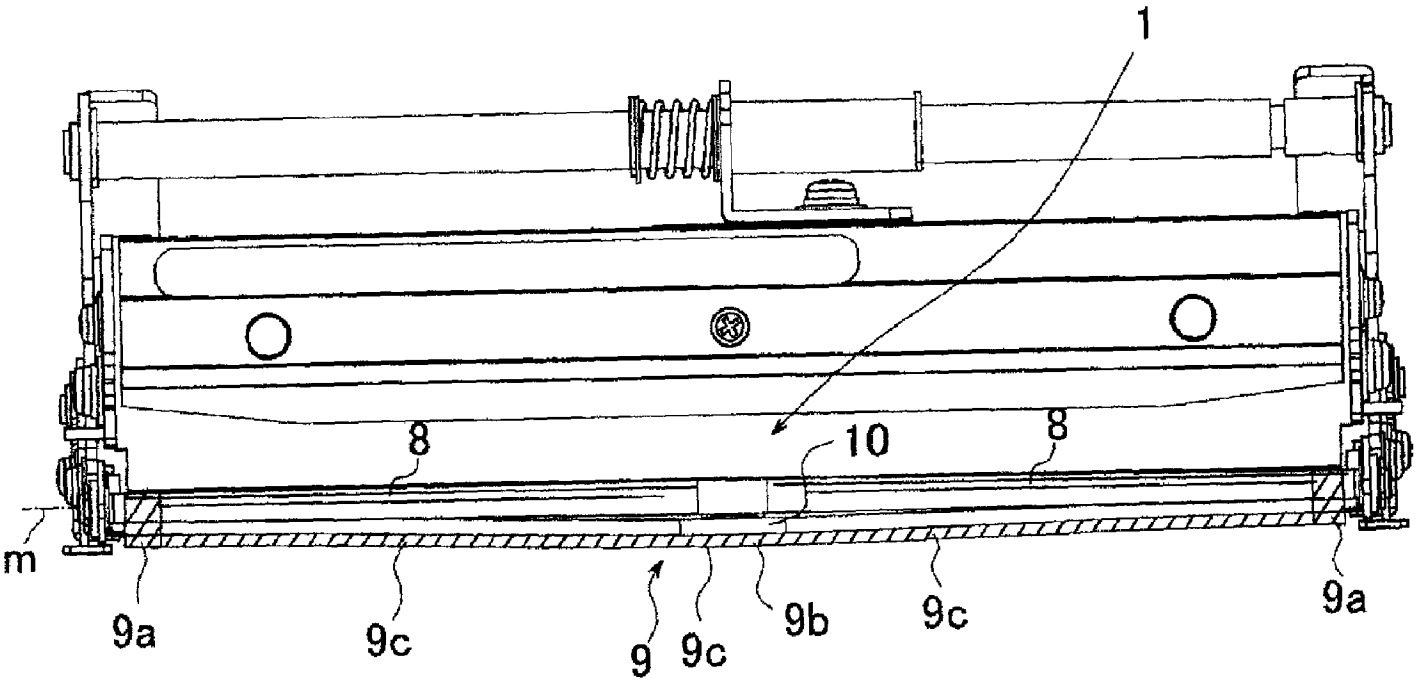
FIG. 3 is a plan view corresponding to FIG. 2.

FIGS. 2 and 3 show specific examples of the arrangement in which the peeling roller 8 is attached to the thermal head structure 1 together with this tension plate 9. The thermal head 2 is positioned at the lower face side in FIG. 2, and the peeling roller 8 is mounted on the downstream side thereof via the axis "m" parallel to a line. The tension plate 9 is further mounted on the thermal head structure 1 along the axis "m" in the longitudinal direction at the downstream neighboring position thereof. The tension plate 9 is fixed at both ends 9*a*, and is pressed by means of the spacer 10 interposed between a center part 9*b* and the thermal head structure 1. This plate is gently curved in its entirety, and is the most expandable at the center part 9*b*. Of course, a plastic deformation process is applied to the tension plate 9 per se, so that a predetermined curved shape is obtained. A ribbon opposite face 9*c* of this tension plate 9 is also a cross-sectional R-shaped portion formed at a folded position of a plate member, as shown in FIG. 1.

The guide roller 6 and the ribbon roll 7 shown in FIG. 1 are disposed at the printer main body so as to form a predetermined positional relationship with this thermal head structure 1. The ink ribbon 4 is sequentially wound around the peeling roller 8, the tension plate 9, the guide roller 6, and the ribbon roll 7 so as to achieve a state in which the expanded ribbon opposite face 9*c* of the tension plate 9 is pressed against a back face free of the dyestuff of the ink ribbon 4.

Figure 4:
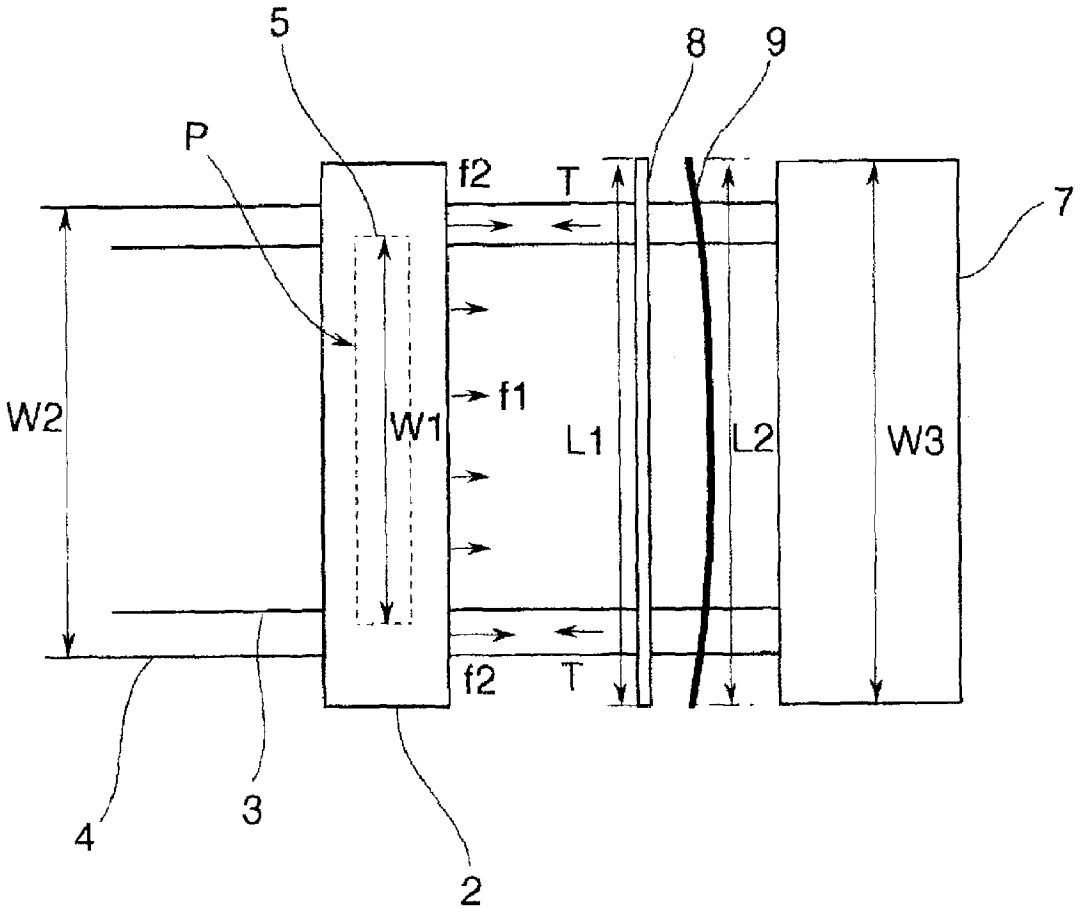
FIG. 4 is an explanatory view of functions of the constituent elements in the embodiment.
Figure 5:
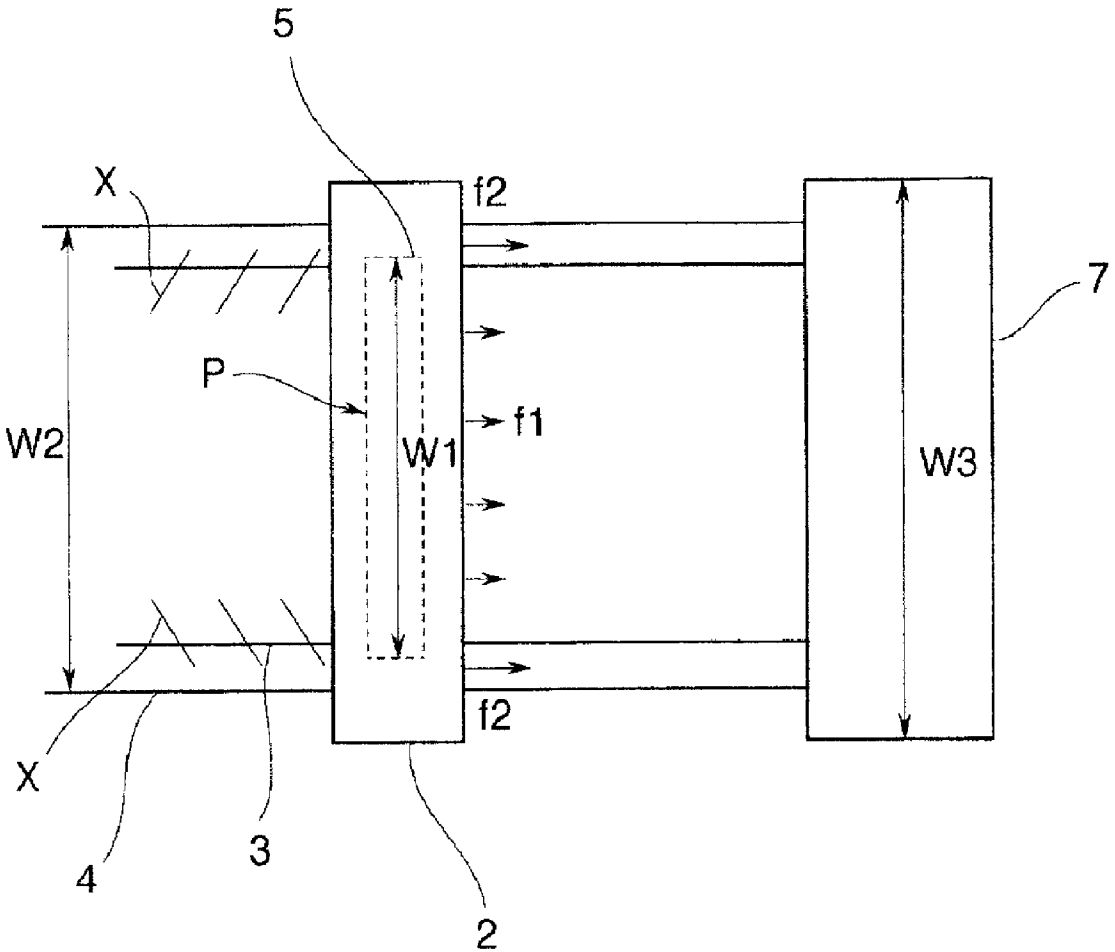
FIG. 5 is a view for explaining failures associated with a conventional printer.

In the above description, in the head-up state, the printer is arranged so as to obtain a state in which the ink ribbon 4 does not come into contact with the tension plate 9, eliminating influence upon the ink ribbon 4. Further, this thermal printer has a relationship that a respective one of the ribbon width W2 of the ink ribbon 4 and the roll width W3 of the ribbon roll 7 becomes larger in comparison with the printing width W1 at the printing position P set between the thermal head 2 and the platen roller 5, as shown in FIG. 4 corresponding to FIG. 5. In addition, in the peeling roller 8 and the curved tension plate 9 that are newly employed in the embodiment, a respective one of the longitudinal dimensions L1, L2 thereof is set to be larger than at least the ribbon width W2 of the ink ribbon 4.

In the abovementioned construction, when printing is executed, a back tension T acts on the ink ribbon 4 situated at the printing position P via the peeling roller 8 from the tension plate 9, with the ink ribbon 4 being in slide contact with the tension plate 9. While acceleration of the occurrence of wrinkles due to slackening of the ink ribbon 4 are effectively avoided by means of the tension plate 9, a peeling base point is imparted with the peeling roller 8 rolling with the ink ribbon 4, thereby making it possible to effectively eliminate problems such as lowered quality of paper due to retention of dust or the like at one site and damaging the paper. Moreover, the tension plate 9 is positioned on the downstream side distant from the peeling position. At this position, the used ink ribbon 4 alone merely comes into pressure contact with the tension plate 9, and the paper 3 is already peeled and does not exist. Therefore, even if dust or the like is accumulated at the slide portion of the tension plate 9, an inconvenience such as damaging the paper does not occur.

Even if the conveyance force f1 at the center part of the ink ribbon 4 becomes lower than the conveyance force f2 at an end thereof, due to a resistance at the printing position P, the back tension T acts on the ink ribbon 4 situated at the printing position P via the peeling roller 8 from the tension plate 9, according to the curved shape of the tension plate 9. Further, the back tension T appears at a widthwise end precedent to the center part, and acts on the printing position P. Therefore, a difference between the conveyance forces f1 and f2 is balanced out, and the conveyance force relative to the ink ribbon 4 is uniformed along the widthwise direction. In another point of view, when the widthwise center part of the ink ribbon 4 has expanded, even if the widthwise end and the center part attempt to act as the ahead side and the delay side, respectively, the center part of the tension plate 9 is expanded to lengthen a path, and is redundantly pulled, thereby achieving a uniformed tension, or alternatively, a balanced speed of paper feeding due to a temporarily accelerated feeding speed at the center part of the ink ribbon 4.

In either case, a construction is employed such that: the ribbon opposite face 9*c* of the tension plate 9 shown in FIG. 1 is pressed against the ink ribbon 4 with the plate being formed to be more protuberant at the center side than at the widthwise end side, as shown in FIG. 4, for example; and feeding, which is substantially uniform with respect to the widthwise direction of the ink ribbon 4, is performed. Thus, it becomes possible to effectively eliminate or mitigate problems such as the occurrence of wrinkles caused by a large or small conveyance force, or alternatively, the presence or absence of expansion of the ink ribbon 4, and furthermore, the occurrence of non-uniform printing.

While a tension member can be constructed partly of a block body or the like as long as it has a face with which the ink ribbon 4 is brought into contact, the tension plate 9 made of a plate member as a tension member is employed in the embodiment. Thus, a structure of the printer is simplified, and moreover, an appropriate degree of curvature according to the printing characteristics can be arbitrarily set by utilizing the plate member.

Further, this thermal transfer printer of the embodiment forms a relationship that a respective one of the ribbon width W2 of the ink ribbon and the roll width W3 of the ribbon roll 7 is larger in comparison with the printing width W1 at the printing position set between the thermal head 2 and the platen roller 5. However, in the thermal transfer printer of such type, wrinkles are prone to occur with the ink ribbon, in particular, due to the conveyance force between a printing area and a non-printing area or due to a difference in the presence or absence of thermal damage. Therefore, there is attained a particular effect that printing quality or printed-paper quality can be remarkably improved by applying the present invention controlling back tension of the ink ribbon 4 between the printing area and the non-printing area.

In comparison with the Patent Document 1, there is a difference in that a peeling plate is employed for the purpose of peeling in the Patent Document 1, whereas a peeling roller is disposed at a peeling position and a tension plate is employed for the purpose of tension in the embodiment. In addition, there is also a difference in an aspect of curvature in that peeling starts from an end in the embodiment. Further, there is a difference in that, in the Patent Document 1, in respect of the degree of curvature of the plate, a principal objective is to reduce paper damage by shifting a peeling timing and the peeling plate can be replaced with a roller, whereas in the embodiment, a principal objective is to reduce the occurrence of wrinkles in an ink ribbon by controlling a back tension in accordance with a paper conveyance force or a thermal load. Furthermore, there is a difference in that a tension member is limitative to a member of sliding an ink ribbon, and there is substantially a difference in that the shape of curvature of the plate is also determined based upon a clear standard newly found, such as a conveyance force or a thermal load.

The specific construction of constituent elements is not limitative to the above-described embodiment, and various modifications can occur without departing from the spirit of the invention.

What is claimed is:

1. A thermal transfer printer, comprising:

a peeling roller which is disposed downstream of a printing position set between a thermal head and a platen roller, and defines a peeling start position of an ink ribbon; and a tension member which is disposed on a further downstream side than the peeling roller, and slidably stretches the ink ribbon under a tension relative to the printing position, via the peeling roller, wherein a respective one of a ribbon width of the ink ribbon and a roll width of a ribbon roll is larger in comparison with a printing width at a printing position set between the thermal head and the platen roller.

2. The thermal transfer printer according to claim 1, wherein a ribbon opposite face of the tension member is provided to be shaped more protuberantly at a center side than at a widthwise end side thereof.

3. The thermal transfer printer according to claim 1, wherein the tension member is a tension plate made of a plate material.

4. The thermal transfer printer according to claim 2, wherein the tension member is a tension plate made of a plate material.

5. A thermal transfer printer, comprising:

a peeling roller which is disposed downstream of a printing position set between a thermal head and a platen roller, and defines a peeling start position of an ink ribbon; and a tension member which is disposed on a further downstream side than the peeling roller, and slidably stretches the ink ribbon under a tension relative to the printing position, via the peeling roller, wherein a ribbon width of the ink ribbon is larger in comparison with a printing width at a printing position set between the thermal head and the platen roller.

6. The thermal transfer printer according to claim 5, wherein a ribbon opposite face of the tension member is provided to be shaped more protuberantly at a center side than at a widthwise end side thereof.

7. The thermal transfer printer according to claim 5, wherein the tension member is a tension plate made of a plate material.

8. The thermal transfer printer according to claim 6, wherein the tension member is a tension plate made of a plate material.

* * * * *